US005464323A

United States Patent [19]

Scofield

[11] Patent Number: 5,464,323

[45] Date of Patent: Nov. 7, 1995

[54] VIBRATION ISOLATION SYSTEM FOR FAN BLADE

[75] Inventor: Robert L. Scofield, Cordova, Tenn.

[73] Assignee: Hunter Fan Company, Memphis, Tenn.

[21] Appl. No.: 204,865

[22] Filed: Mar. 2, 1994

[51] Int. Cl.[6] ..... F04D 29/66

[52] U.S. Cl. ..... 416/134 R; 29/889

[58] Field of Search ..... 416/134 R, 204 R, 416/210 R; 29/525.1, 889

[56] References Cited

U.S. PATENT DOCUMENTS

| | | | |
|---|---|---|---|
| 404,964 | 6/1889 | Elliott . | |
| 925,031 | 6/1909 | Russel . | |
| 2,041,507 | 5/1936 | Zeder . | |
| 2,041,555 | 5/1936 | Lee . | |
| 2,270,583 | 1/1942 | Forton . | |
| 2,965,180 | 12/1960 | Killam . | |
| 3,014,563 | 12/1961 | Bratton | 29/525.1 |
| 3,861,828 | 1/1975 | Biermann et al. . | |
| 3,909,927 | 10/1975 | Steward | 29/525.1 |
| 4,437,784 | 3/1984 | Peterson | 29/525.1 |
| 4,511,310 | 4/1985 | Pearce . | |
| 4,850,799 | 7/1989 | Bucher, Sr. et al. . | |
| 4,917,573 | 4/1990 | Sikula, Jr. . | |
| 4,998,332 | 3/1991 | Dacey, Jr. | 29/525.1 |
| 5,304,037 | 4/1994 | Scofield | 416/134 R |
| 5,314,280 | 5/1994 | Gagliardi et al. | 29/525.1 |

FOREIGN PATENT DOCUMENTS

| | | | |
|---|---|---|---|
| 0759535 | 1/1953 | Germany | 416/134 R |
| 0674340 | 6/1952 | United Kingdom | 416/134 R |

*Primary Examiner*—Edward K. Look
*Assistant Examiner*—Mark Sgantzos
*Attorney, Agent, or Firm*—Baker, Donelson, Bearman & Caldwell

[57] ABSTRACT

A vibration isolation assembly for use in securing a fan blade, particularly a ceiling fan blade, to a mounting surface having a plurality of mounting holes formed herein, the blade having an equal number of through holes in a proximate end thereof alignable with the mounting holes. The vibration isolation assembly comprises a plurality of first resilient members securable to the mounting surface adjacent each mounting hole, a plurality of second resilient members disposable within the through holes in the blade, with each second resilient member having a longitudinal hole formed therethrough, and a plurality of screws insertable through the holes in the first and second resilient members and engageable within the mounting holes in the mounting surface for fastening the blade to the mounting surface. In a preferred embodiment, the first resilient members are operative to prevent contact between the blade and mounting surface, and the second resilient members are operative to prevent contact between the screws and the blade.

7 Claims, 1 Drawing Sheet

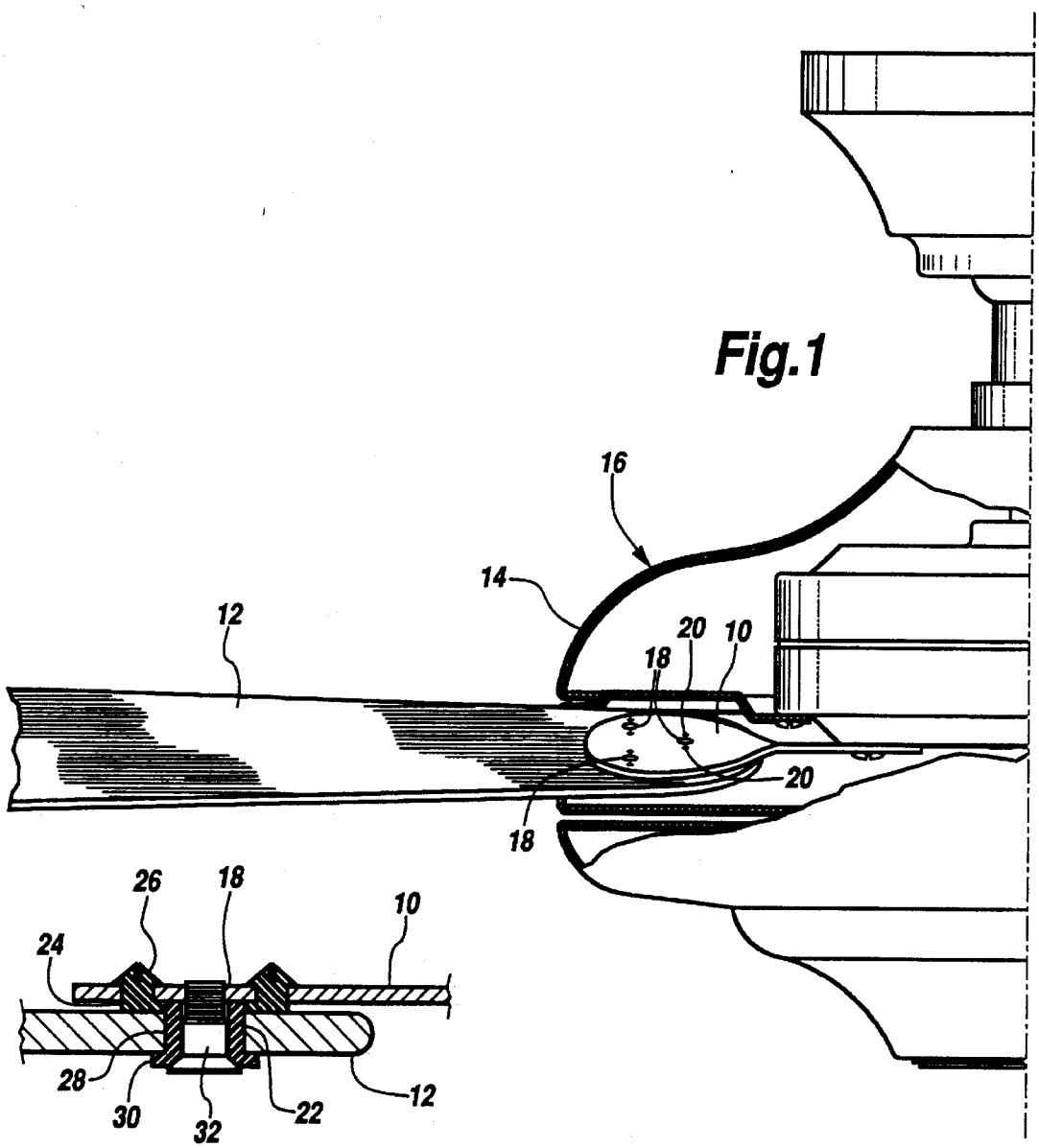
Fig.1
Fig.2
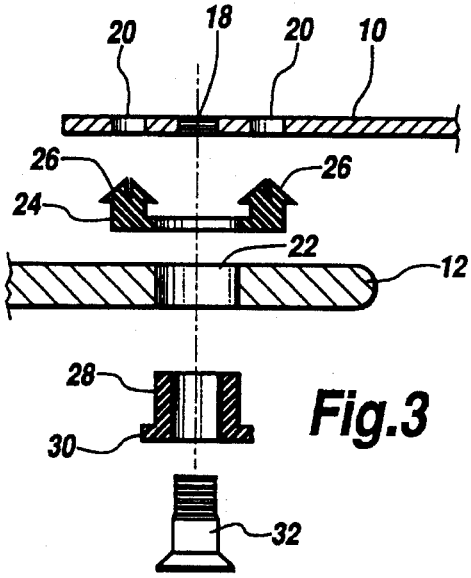
Fig.3

VIBRATION ISOLATION SYSTEM FOR FAN BLADE

BACKGROUND OF THE INVENTION

Field

This invention relates to vibration reduction assemblies for fan blades and, more particularly, to a two-piece vibration isolation assembly for use in a ceiling fan.

Description of the Prior Art

It is generally known in the ceiling fan industry that blade vibration is undesirable, causing an unacceptably high level of noise to emanate from the blades during operation. While a certain amount of vibration is unavoidable, it has been found preferable to minimize the amount of vibration transmitted from the motor to the blades in order to effect smooth, quiet operation. Accordingly, some type of vibration isolation system is commonly employed to reduce the transmission of vibration from the ceiling fan motor through the blade irons to the blades.

Two known prior art references disclose the use of vibration dampers composed of rubber, or a similar elastomeric compound, disposed between the base of the blade iron and the fan motor. U.S. Pat. No. 4,850,799, issued Jul. 25, 1989 to Bucher, et al., discloses a two-part "rubber fly wheel" having a rigid core formed from steel. U.S. Pat. No. 4,511,310, issued Apr. 16, 1985 to Pearce discloses a similar device comprising a rigid ring having elastomeric inserts. Both the Bucher et al. and Pearce devices are fastened to the rotor of the fan motor by a plurality of screws, prior to attaching the blade irons. While these devices may be effective, they add unnecessary cost to the fan and increase the complexity of the installation and/or assembly.

It is also known to insert an elastomeric grommet into the mounting hole of a conventional ceiling fan to isolate the blade from the blade iron. Such grommets typically comprise a tubular center section with an annular shoulder at each end. Installation of such grommets requires deforming one end thereof, including the shoulder formed thereabout, for insertion through the blade mounting hole. If the grommet is not properly installed, its effectiveness in reducing vibration is destroyed, or at least severely compromised.

BRIEF SUMMARY OF THE INVENTION

It is an object of this invention to provide a vibration isolation system for use in securing a fan blade to a blade iron, or similar mounting bracket, which significantly reduces the transmission of vibration from the fan motor to the blades.

It is a further object of this invention to provide such a vibration isolation assembly which is easy to install by an untrained person.

Another object is to provide such a vibration isolation assembly which is inexpensive to manufacture.

These and other objects are achieved in the present invention, which comprises a pair of resilient, preferably elastomeric, grommets or similar vibration isolation members which effectively prevent direct contact between the blade and blade iron in a ceiling fan. A first such resilient member is securable to the blade iron adjacent each blade mounting hole, and the second resilient member is disposed in each through hole in the proximate end of the blade. A conventional screw is insertable through the resilient members to secure the blade to the blade iron, wherein the resilient members cooperate to prevent direct contact between the blade and either the screw or the blade iron.

Additional objects and advantages provided by this invention will become apparent to those skilled in the art upon reading the following detailed description in conjunction with the appended drawings.

BRIEF DESCRIPTION OF THE DRAWINGS

FIG. 1 is a side elevational view, partially in section, of a portion of a ceiling fan incorporating the vibration isolation assembly of the present invention;

FIG. 2 is a side sectional view through the vibration isolation assembly of the present invention, as installed in a typical ceiling fan; and FIG. 3 is an exploded side sectional view of the vibration isolation assembly shown in FIG. 2.

DETAILED DESCRIPTION OF THE PREFERRED EMBODIMENT

As shown in FIG. 1, the preferred embodiment of this invention is intended for use in a ceiling fan having a non-decorative blade iron 10 secured to a conventional blade 12 within motor housing 14 of fan 16. It will be readily appreciated by those skilled in the art, however, that principles of this invention may also be applicable to other blade mounting configurations, including, for example, a fan having blades secured directly to a mounting surface on the motor, or a fan utilizing conventional blade irons extending exteriorly of the motor housing. While the vibration isolation assembly of this invention was designed primarily for use with a ceiling fan in the nature of fan 16 depicted in FIG. 1, the principles taught herein are not so limited.

As shown in FIG. 1, the distal end of blade iron 10 may include three threaded mounting holes 18, each of which is flanked by a pair of attachment holes 20. FIGS. 2 and 3 illustrate the preferred vibration isolation assembly associated with a representative mounting hole 18 and corresponding through holes 20. The remainder of this detailed description focuses on the representative assembly, although it will be understood that a plurality of such assemblies are typically employed for each fan blade. In the embodiment shown, three such assemblies are employed, one for each mounting hole 18 in blade iron 10. Similarly, blade 12 includes a like number of through holes 22 formed therethrough, alignable with mounting holes 18. It is to be clearly understood, however, that it may be preferable to employ only two mounting holes 18 and a like number of through holes 22, depending on the circumstances, and that the scope of this invention is not limited by the number chosen.

Referring now to FIGS. 2 and 3, the vibration isolation assembly of this invention comprises a first resilient member 24 securable to blade iron 10 in the immediate vicinity of mounting hole 18. In the preferred embodiment shown, resilient member 24 is in the shape of a flat washer, having a pair of diametrically opposed studs 26 integrally formed thereon. Studs 26 are configured for engagement with attachment holes 20, whereby resilient member 24 may be secured annularly adjacent mounting hole 18.

This invention further comprises a second resilient member 28 removably insertable into through hole 22 in blade 12. Resilient member 28 has a tubular body, with a shoulder 30 formed about one end thereof. It is to be understood that resilient members 24 and 28 are preferably formed from an elastomeric material such as natural or synthetic rubber, but may be formed from any vibration damping material suitable for the purpose.

The preferred method of installing the vibration isolation assembly is as follows. First, resilient member 24 is secured to blade iron 10 by inserting studs 26 into attachment holes 20. Resilient member 28 is then inserted into through hole 22 with shoulder 30 fitting snugly against the lower surface of blade 12, annularly disposed about through hole 22. With holes 18 and 22 suitably aligned, a conventional screw 32 is inserted through resilient members 28 and 24 and threadingly engaged within mounting hole 18. Upon tightening screw 32, the vibration isolation assembly of this invention is formed, thereby securing blade 12 to blade iron 10 while effectively isolating the components to eliminate the transmission of vibration from one to the other. Resilient member 28 effectively isolates blade 12 from screw 32, while resilient member 24 isolates blade 12 from blade iron 10.

While the principles of providing a two-part vibration isolation assembly for use in a ceiling fan are disclosed herein, it will be expected that various modifications may be made to the preferred embodiment without departing from the spirit and scope of this invention. Accordingly, the scope of this invention is to be limited only by the prior art and the following claims.

What is claimed is:

1. A vibration isolation assembly for use in securing a fan blade to a mounting surface having a plurality of mounting holes formed therein, said fan blade having an equal number of through holes in a proximate end thereof alignable with said mounting holes, said fan blade also having opposite front and back sides, said assembly comprising:

a plurality of first resilient members for preventing contact between said blade and said mounting surface, each of said first resilient members having attachment means for engaging with a plurality of corresponding attachment holes provided in said mounting surface to secure the first resilient members to said mounting surface;

a plurality of second resilient members disposable within said through holes in said blade, each said second resilient member having a longitudinal hole formed therethrough; and fastening means insertable through the holes in said second resilient members and engageable with the mounting holes in said mounting surface for fastening said blade to said mounting surface in such a manner that said second resilient members prevent contact between said fastening means and said blade.

2. A vibration isolation assembly as set forth in claim 1, wherein:

said mounting holes in said mounting surface are threaded; and said fastening means comprise a plurality of screws.

3. A vibration isolation assembly as set forth in claim 1, wherein:

each of said second resilient members comprises a generally tubular grommet having an annular shoulder formed at one end thereof which is positioned against the back side of the blade adjacent the through hole when said member is disposed within the through hole so that said shoulder prevents contact between said fastening means and said back side of said blade.

4. A vibration isolation assembly as set forth in claim 1, wherein:

a pair of said attachment holes are diametrically opposed adjacent each of said mounting holes; and said attachment means comprises a pair of diametrically opposed studs which extend from each of said first resilient members and engage with said attachment holes to secure said first resilient members to said mounting surface.

5. A vibration isolation assembly as set forth in claim 1, wherein:

said mounting surface comprises the distal end of a blade iron.

6. A vibration isolation assembly as set forth in claim 4 wherein each of said first resilient members is in the shape of a ring.

7. A method of isolating a fan blade from a mounting surface, said blade having a plurality of through holes formed therein and said mounting surface having a plurality of mounting holes formed therein, said method comprising the steps of:

securing a plurality of first resilient members having a pair of diametrically opposed studs extending therefrom to said mounting surface by inserting said studs in a pair of diametrically opposed attachment holes formed in the mounting surface adjacent said mounting holes to prevent contact between the blade and said mounting surface;

securing a plurality of second resilient members to said blade inside and at least partially adjacent said through holes; and inserting a plurality of screws through said first and second resilient members and said through holes and engaging said mounting holes so that said second resilient members prevent contact between said screws and said blade.

* * * * *